US008967215B2

(12) United States Patent
Bates

(10) Patent No.: US 8,967,215 B2
(45) Date of Patent: Mar. 3, 2015

(54) LABELING DEVICE FOR LABELING OBJECTS, IN PARTICULAR MOVING OBJECTS

(71) Applicant: Marel Limited, Colchester (GB)

(72) Inventor: Steven Bates, Harwich (GB)

(73) Assignee: Marel Limited, Colchester (GB)

( * ) Notice: Subject to any disclaimer, the term of this patent is extended or adjusted under 35 U.S.C. 154(b) by 0 days.

(21) Appl. No.: 13/962,080

(22) Filed: Aug. 8, 2013

(65) Prior Publication Data

US 2014/0041806 A1 Feb. 13, 2014

Related U.S. Application Data

(60) Provisional application No. 61/681,660, filed on Aug. 10, 2012.

(51) Int. Cl.
*B65C 9/08* (2006.01)
*B65C 9/36* (2006.01)
*B65C 9/40* (2006.01)

(52) U.S. Cl.
CPC .... *B65C 9/08* (2013.01); *B65C 9/36* (2013.01)
USPC ..... 156/356; 156/358; 156/360; 156/367; 156/540; 156/556; 156/581

(58) Field of Classification Search
CPC ..... B65C 9/08; B65C 9/36; B65C 9/40
USPC ..... 156/356, 358, 360, 362, 363, 367, 538, 156/540, 556, 581
See application file for complete search history.

(56) References Cited

U.S. PATENT DOCUMENTS

| | | | | |
|---|---|---|---|---|
| 4,595,447 | A * | 6/1986 | Lindstrom | 156/364 |
| 6,009,926 | A * | 1/2000 | Vicktorius et al. | 156/556 |
| 6,978,818 | B1 * | 12/2005 | Vicktorius et al. | 156/556 |
| 2005/0224166 | A1 * | 10/2005 | Whelan | 156/247 |

FOREIGN PATENT DOCUMENTS

| | | | |
|---|---|---|---|
| DE | 19952375 | A1 | 5/2001 |
| DE | 102006043537 | A1 | 3/2008 |

OTHER PUBLICATIONS

Search Report from corresponding EP Application Serial No. 12180377.9, Jun. 7, 2013.

* cited by examiner

*Primary Examiner* — George Koch
(74) *Attorney, Agent, or Firm* — Workman Nydegger

(57) ABSTRACT

A labelling device includes a linearly displaceable piston operably connectable to a moving mechanism for moving the piston from a resting position to a labelling position. A label carrying mechanism is arranged at the distal end of the piston for carrying an adhesive label and affixing the adhesive label to an object via physical contact at the labelling position of the piston. A force-switching-state system is provided to maintain the piston in relation to the moving mechanism in an attracting force state and the piston moves with the moving mechanism. The physical contact creates an opposite repelling force from the object onto the label carrying mechanism causing separation of the displaceable piston from the moving mechanism. This separation causes a change of the force state of the displaceable piston from an attracting to a repelling force state, causing the linearly displaceable piston to move back to the resting position.

17 Claims, 9 Drawing Sheets

LABELING DEVICE FOR LABELING OBJECTS, IN PARTICULAR MOVING OBJECTS

FIELD OF THE INVENTION

The present invention relates to a labelling device adapted to label objects, in particular moving objects such as food objects.

BACKGROUND OF THE INVENTION

FIG. 1 depicts a prior art labelling device 100 for labelling moving objects. A label reel is placed in a holder 101 (label reel assembly), from where a web 102 is manually threaded through a printhead mechanism and finally onto the web take up assembly 106. The web is driven through the printhead mechanism 103 which houses a printing device that prints a label as it passes through the mechanism. Once printed the label is stripped off its backing web or carrier and fed onto a label pickup assembly 104. A linearly displaceable piston 105 is extended to take the label from the label pickup assembly, where the label may be rotated and finally held at a pre-set height above the item being labelled. Once the item is in position the label is blown onto the item.

The disadvantage with such a labelling device is that if the objects to be labelled have uneven surfaces, there is a risk that the labels will not attach to these uneven surfaces, and be blown away from the surfaces. These objects must then either be labelled manually or be recycled into the device in the hope that the next attempt to label the objects will succeed.

Moreover, if the height of the objects to be labelled is irregular and some of the objects have a height that is above the above mentioned pre-set height, the objects will be hit by the linearly displaceable piston, causing a blocking of the labelling device. In such cases, the piston typically moves slowly back to the starting position or an operator of the device must manually move the piston back to the starting position and restart the labelling device. Accordingly, this blocking does not only requrie extra manpower to monitor the device but also the impact from the piston on the object can easily damage the packing and even the object and delay the labelling operation.

The inventor of the present invention appreciated that there is thus a need for an improved labelling device that is capable of labelling objects with uneven surfaces and able to accommodate much greater height variations and has in consequence devised the present invention.

SUMMARY OF THE INVENTION

It would be advantageous to provide an improved labelling device that is capable of labelling objects with uneven surfaces of various heights. In general, the invention preferably seeks to mitigate, alleviate or eliminate one or more of the above mentioned disadvantages singly or in any combination. In particular, it may be seen as an object of the present invention to provide a labelling device that solves the above mentioned problems, or other problems, of the prior art.

To better address one or more of these concerns, in a first aspect of the invention a labelling device for labelling objects, in particular moving objects, is provided comprising:

- a linearly displaceable piston operably connectable to a moving mechanism for moving the piston from a resting position to a labelling position and vice versa, and
- a label carrying mechanism arranged at the distal end of the piston for carrying an adhesive label and for affixing the adhesive label to an object via physical contact with the object at said labelling position of the piston, wherein said labelling device further comprises:

- a force-switching-state system operable to maintain said piston in relation to said moving mechanism in an attracting force state such that the piston moves with the moving mechanism from said resting position to said labelling position, wherein said physical contact with the object creates an opposite repelling force from the object onto the label carrying mechanism causes separation of said displaceable piston from said moving mechanism, said separation causing a change of said force state of said displaceable piston from being in an attracting force state to a repelling force state, and causing the linearly displaceable piston to move back to said resting position.

Accordingly, as the label carrying mechanism comes into physical contact with the objects, the risk that the labels will be blown away from the objects is prevented. Also, by utilizing said repelling force as a kind of a "trigger" to switch the force-switching-state from being in an attracting force state to a repulsing force state and cause said displaceable piston to automatically move back to said resting position provides an effective way to return the piston back to said resting position where it is ready to label the forthcoming objects. Moreover, labelling objects of variable height is no longer an issue since as soon as the said repelling force is present the piston will move automatically back to said resting position.

In one embodiment, said force-switching-state system comprises:

- a piston magnet rigidly fixed to said piston,
- a fixed magnet positioned distally away from said label carrying mechanism at a position defining said resting position, and
- a drive coupling housing circumferentially surrounding said piston and attached to said moving mechanism in a linearly slidable manner, said drive coupling housing having a cavity facing said fixed magnet, and comprising means for generating a localized magnetic field within said cavity so as to provide an attractive magnetic force on said piston magnet when the piston magnet is positioned in said cavity and define said attractive force state, wherein said displacement of the piston from said resting position, where said drive coupling housing is positioned adjacent to said fixed magnet with the piston magnet placed therebetween, towards said labelling position is based on movement of the moving mechanism and thus linear movement of the drive coupling housing, said attractive magnetic force on said piston magnet causing a simultaneous linear movement of the piston from said resting position to said labelling position.

In one embodiment, said opposite repelling force from the object onto the label carrying mechanism causing said separation of said displaceable piston from said moving mechanism is based on linear displacement of the piston magnet from said cavity of the drive coupling housing towards said fixed magnet, said fixed magnet being selected such that the field strength of the fixed magnet is of a size such that, upon release of said piston magnet from said localized magnetic field, said fixed magnet exerts a force larger than the force exerted by said localized magnetic field, causing the piston magnet and thus the piston to accelerate towards the fixed magnet.

The fact that the magnetic field is more or less present only in said cavity means that only a slight displacement of the piston magnet is needed to trigger the repelling force of the piston back to said starting position. This slight deviation results in a reduced impact onto the objects since the piston, upon exerting a mechanical force onto the objects, reacts almost immediately by automatically moving back to the starting position.

In one embodiment, said labelling device further comprises a control unit operable to automatically move the drive coupling housing back to said resting position and into said attracting force state. Accordingly, by almost immediately moving the drive coupling housing back to the resting position, the piston is brought back into said an attracting force state with the drive coupling housing, allowing the piston to move with the moving mechanism and thus label the next object.

In one embodiment, said label carrying mechanism includes a flexible pad connected to a media source for providing a negative pressure. As the pad is flexible, it will easily deflect when interacting physically with the objects and thus put the label onto almost all kinds of surfaces irrespective of their shapes.

In one embodiment, a labelling system is arranged at a position in proximity to the label carrying mechanism at said resting position, wherein at said resting position the labelling system supplies a label which is subsequently sucked via said negative pressure and held by the label carrying mechanism by said suction media source. In an embodiment the media source is further operable to supply a positive pressure.

In one embodiment, said linearly displaceable piston is further operably connected to a height adjustment mechanism adapted to adjust a threshold height level for said labelling position. In an embodiment, if the threshold height level is above an object to be labelled, a media source signal is issued instructing the media source to switch to a positive pressure state and blow the adhesive label onto the object. In that way, in extreme situations where the label carrying device is not capable of coming into physical contact with the objects, e.g. because of how extreme low the height level of the object is, it is still ensured that the labelling operation will be completed.

In one embodiment, said piston is further operable to rotate around a longitudinal axis of the piston. In that way the labelling operation may include rotating the labels so that certain type of objects are labelled differently, such as by rotating the labels through 180° or 90°, for example. This additional operation is preferably operated by a control unit coupled to the piston/labelling device.

In one embodiment, said labelling device further comprises a sensor arranged in the proximity of said resting position and adapted to sense when said linearly displaceable piston is in said resting position, the sensing signal from the sensor being utilized by a control unit as input data in operating the inflow rate of objects to be labelled.

In one embodiment, said moving mechanism is an endless drive belt positioned alongside said piston, comprising at least one driving wheel and operated by said control unit, said drive coupling housing being attached to said endless drive belt.

In one embodiment, said linearly displaceable piston and said moving mechanism are operably connected to a driving mechanism to adjust the lateral position of the piston and the moving mechanism in a direction transverse to the moving direction of the objects. In that way it is possible to select an exact position of the labels on the objects.

In general the various aspects of the invention may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

Embodiments of the invention will be described, by way of example only, with reference to the accompanying schematic drawings, in which.

DESCRIPTION OF EMBODIMENTS

Figure 2A:
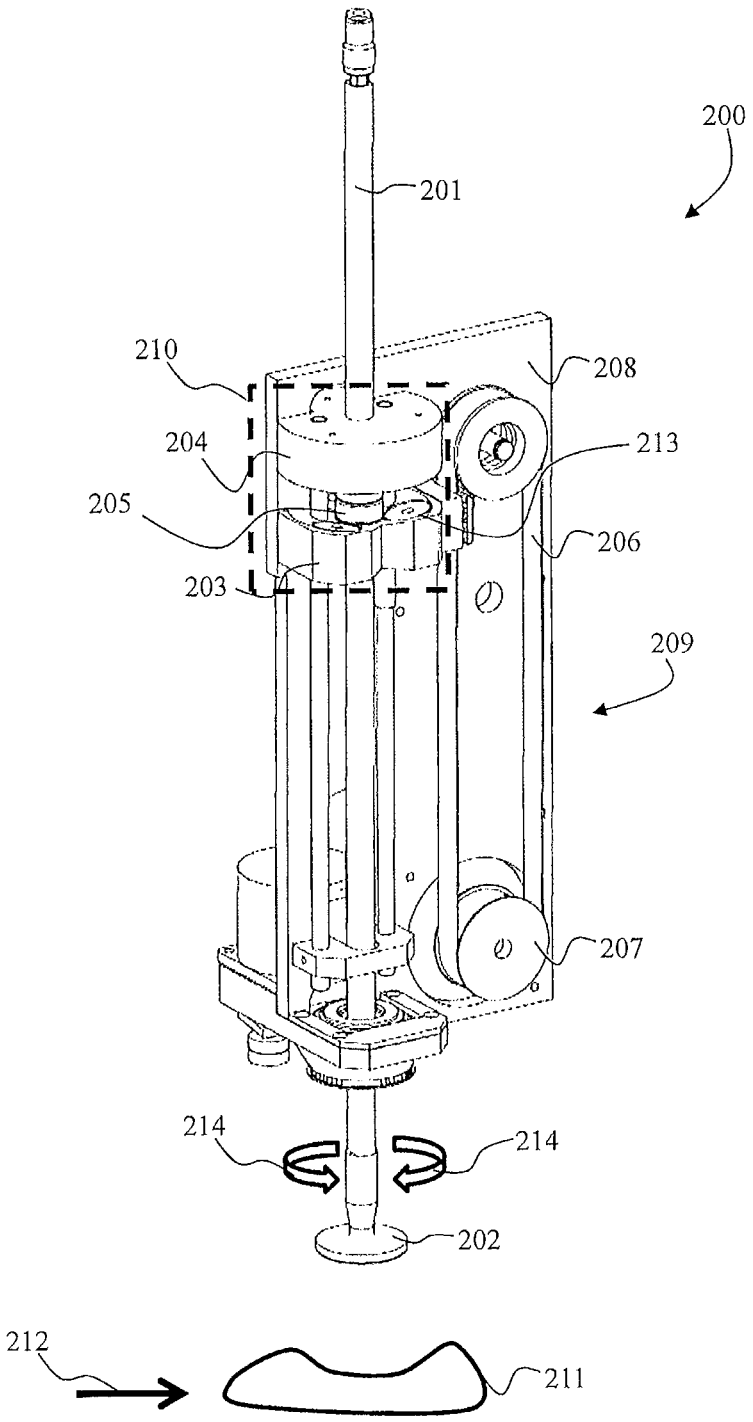
FIGS. 2*a*, 2*b*, 3*a*, 3*b*, 4*a* and 4*b* depict perspective views and front views of one embodiment of a labelling device according to the present invention for labelling objects, in particular moving objects, at successive stages in its operation.
Figure 2B:
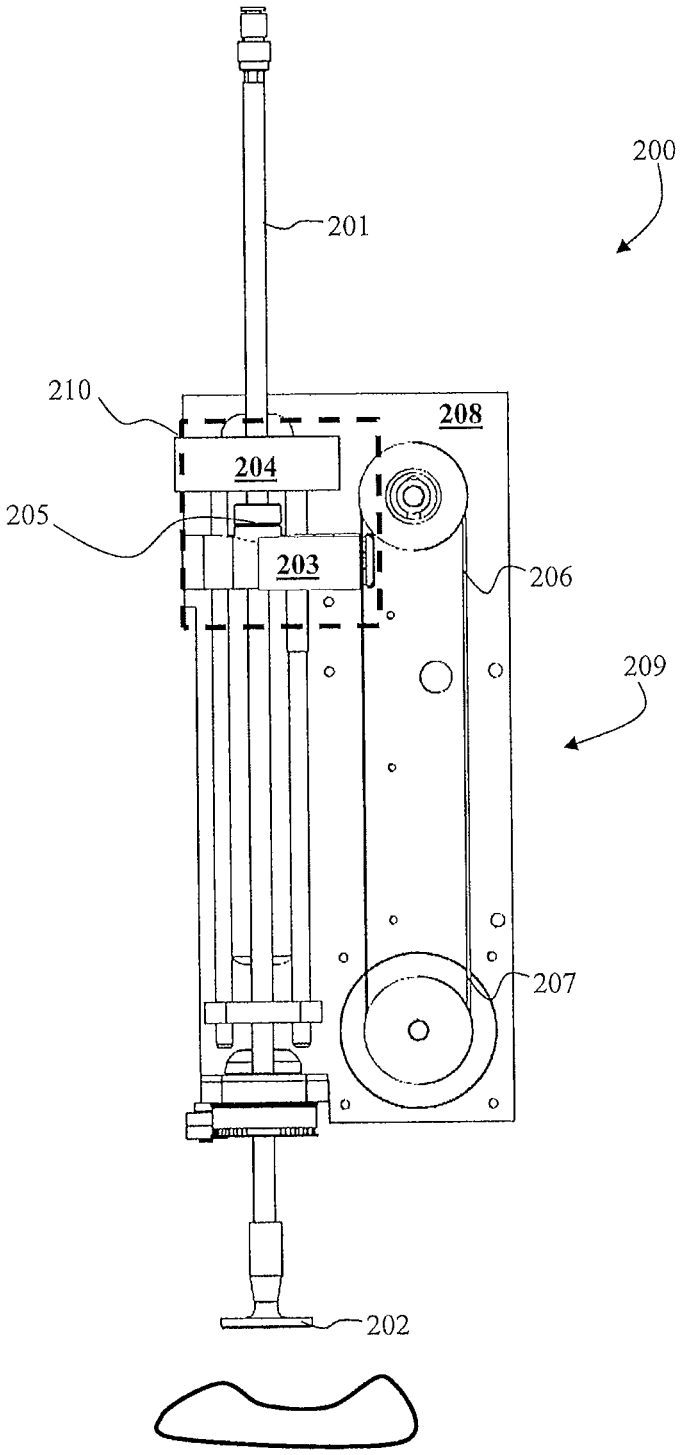
Figure 3A:
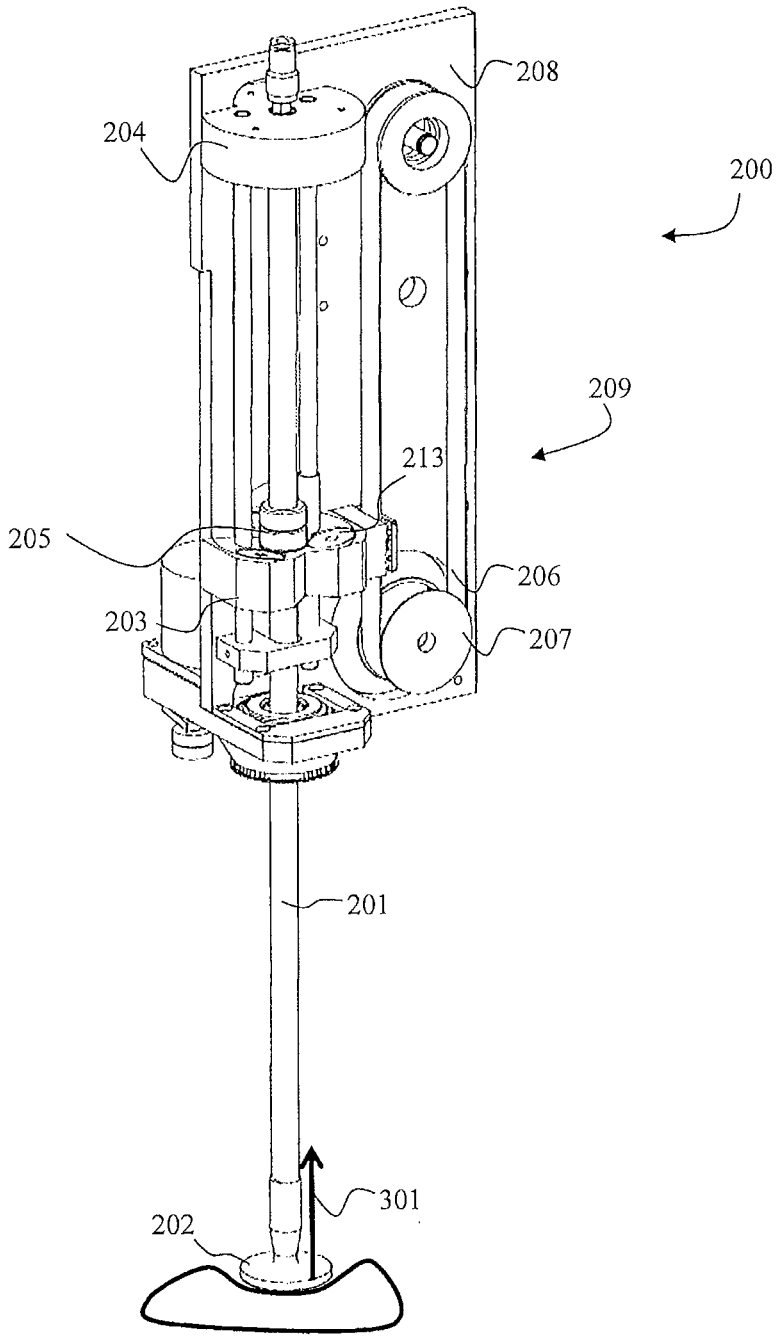
Figure 3B:
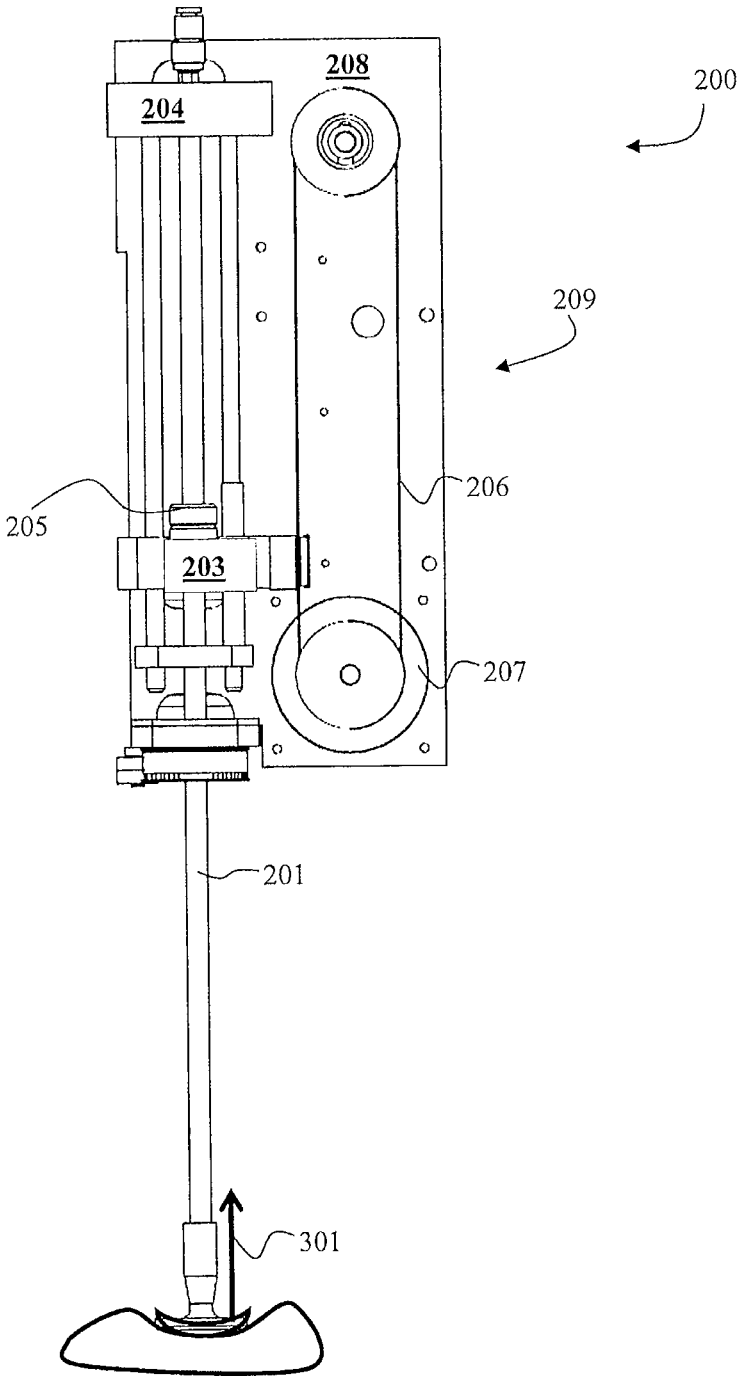
Figure 4A:
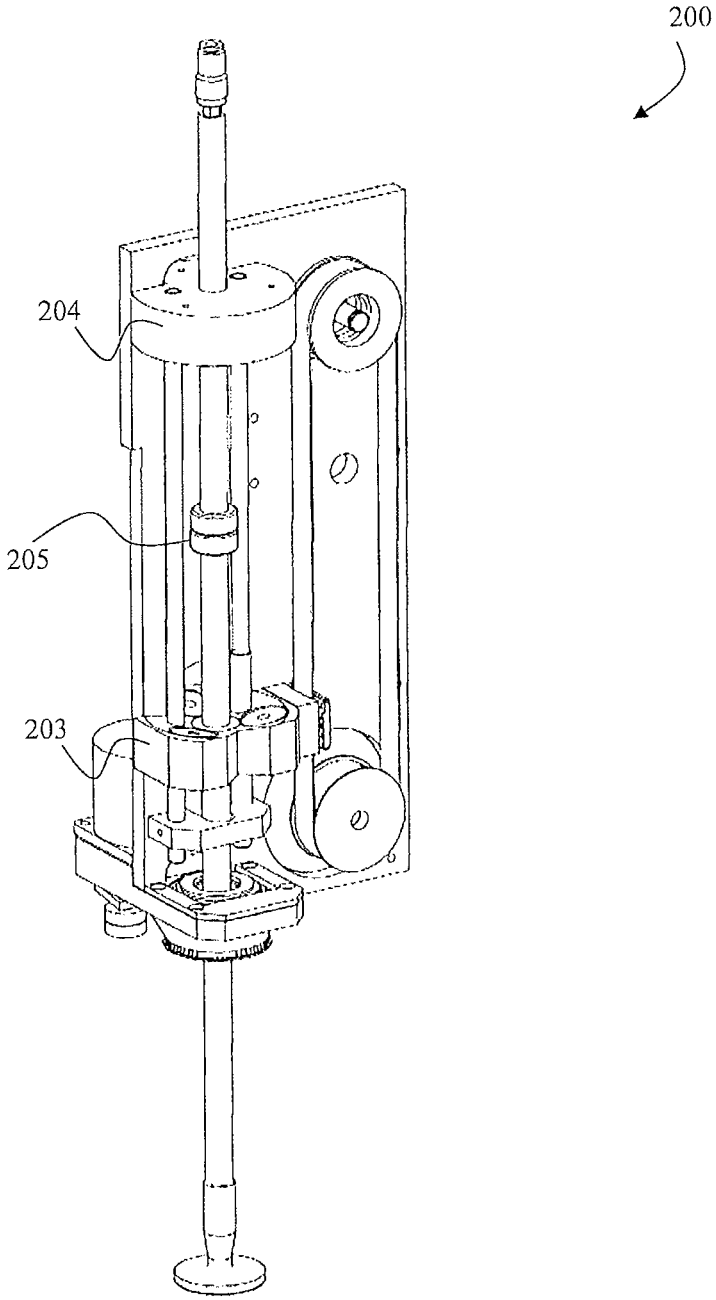
Figure 4B:
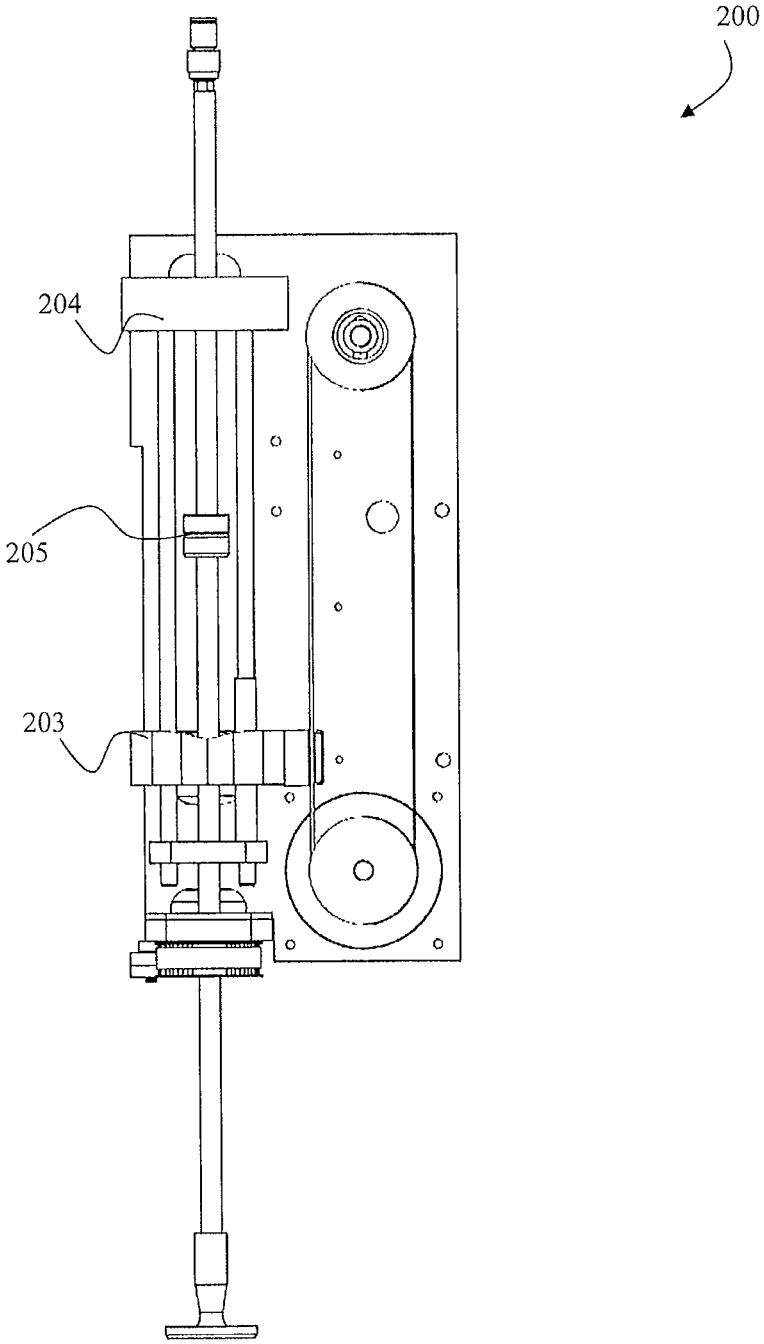

FIGS. 2 to 4 depict perspective views and front views of one embodiment of a labelling device 200 according to the present invention for labelling objects 211, in particular moving objects as indicated by the arrow 212, where the objects may be moved on any type of conveyor means (not shown). The objects may be of any type, such as food products or any type of non-food product.

The labelling device comprises a linearly displaceable piston 201, a label carrying mechanism 202, a force-switching-state system 210, a moving mechanism 209 and a frame structure 208.

The linearly displaceable piston 201 is operably connectable to the moving mechanism 206 for moving the piston from a resting position to a labelling position and vice versa. In this embodiment, the moving mechanism comprises an endless belt 206 extending alongside the piston 201 between two wheels including a driving wheel 207. The coupling between the piston 201 and the endless belt 206 will be discussed in more detail later.

As depicted here, the label carrying mechanism 202 is arranged at the distal end of the piston 201 and is adapted to carry an adhesive label (not shown) and to affix the adhesive label to an object 211 via physical contact with the object at said labelling position of the piston 201. In this embodiment, the labelling carrying mechanism 202 is a flexible pad connected to a media source (not shown) for providing a negative pressure, i.e. suction function, to maintain the label fixed at the flexible pad. The flexible pad 202 is selected such that it can easily adapt to different surfaces, e.g. inclined or declined surfaces, or u-shaped surfaces. For example, the pad may be formed of a rubber or plastic material of any type that is flexible.

Figure 1:
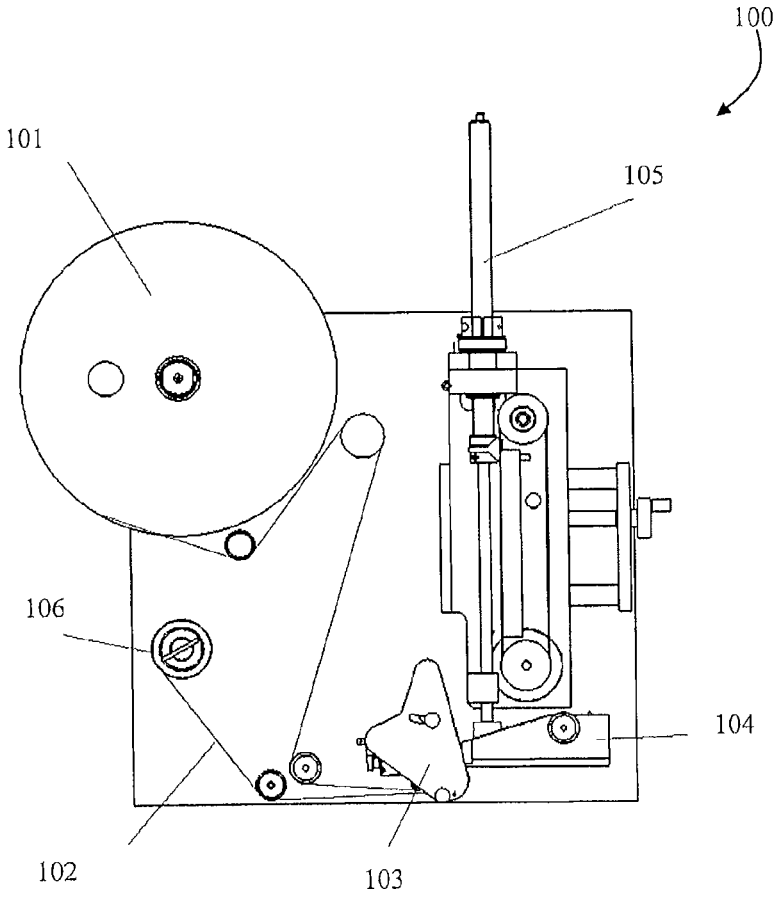
FIG. 1 (prior art)
FIG. 1 depicts a prior art labelling device.

A labelling system may as an example be arranged at a position in proximity to the label carrying mechanism 202, similar to the arrangement depicted in FIG. 1, at the resting position of the piston. Whilst the piston is in its resting position, the labelling system is arranged to supply a label which is subsequently sucked via the negative pressure and held by the flexible pad by the suction media source.

For clarification, FIGS. 2 to 4 show the labelling device 200 in different operational positions, where FIGS. 2*a* and *b* show the labelling device 200 in the resting position, FIGS. 3*a* and *b* show the labelling device 20 in the labelling position, and FIGS. 4*a* and *b* show the labelling device in an intermediate position during the transfer from the labelling position towards the resting position.

The force-switching-state system 210 is operable to maintain the piston 201 in relation to the belt 206 in an attracting force state such that the piston moves with the belt 206 from the resting position shown in FIG. 2 towards the labelling position shown in FIG. 3 while maintaining this attracting force at all times. When the flexible pad 202 comes into physical contact with the object 211, an opposite repelling force 301 is exerted by the object 211 onto the pad 202, causing separation of the displaceable piston 201 from the belt 206. This separation causes a change of the force state of the displaceable piston 201 from being in an attracting force state to a repelling force state causing the linearly displaceable piston to move back to the resting position.

In the embodiment depicted here this force state is based on an interplay between magnetic forces which will be discussed in more detail below, but it should be noted that the solution of the present invention should not be construed as being limited to magnetic forces. The interplay between an electrical field and electrical forces or electromagnetic forces could be applied.

Figure 5:
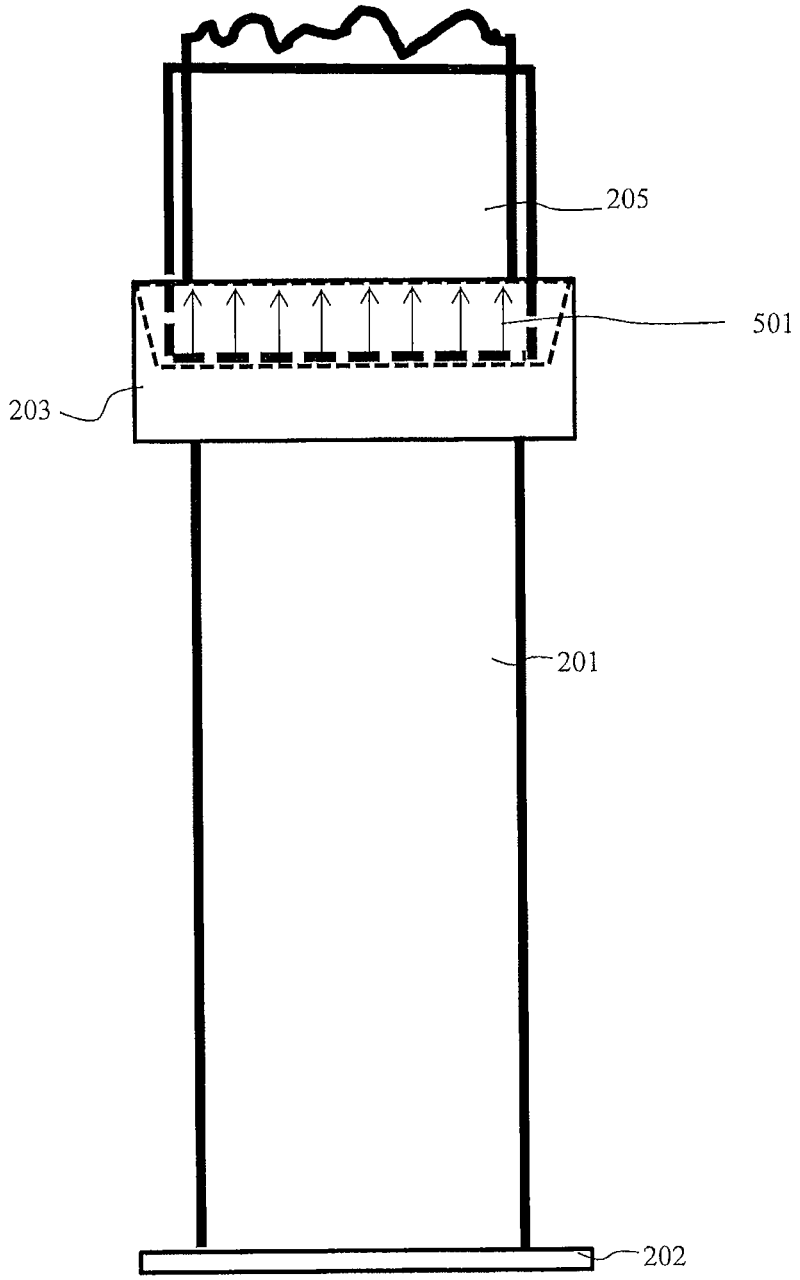
FIG. 5 depicts part of the labelling device of FIGS. 2 to 4 in the attracting force state shown in FIG. 2.

In this embodiment, the force-switching-state system 210 comprises a drive coupling housing 203, a fixed magnet 204 which is rigidly fixed to a frame structure 208 of the labelling device 200 at a position defining said resting position, and a piston magnet 205 that is rigidly fixed to the piston 201. The drive coupling housing 203 circumferentially surrounds the piston 201 in a linearly slidable manner and is attached to the belt 206. The drive coupling housing 203 has a cavity facing the fixed magnet 204 with means for generating a localized magnetic field within the cavity of the same pole direction. This may as an example be achieved by arranging one or more small disc-shaped magnets 213 having the same magnetic poles under an appropriate angle within the cavity and in that way provide said localized magnetic field. Utilizing a piston magnet 205 which is opposite poled compared to this localized magnetic field means that this localized field acts with an attractive magnetic force on the piston magnet 205 when the piston magnet is positioned in the cavity. This state may be defined as said attractive force state. This is depicted in FIG. 5 which shows the piston magnet 205 in position within the cavity, where the localized magnetic field 501 acts with an attractive force on the piston magnet, and thus acts with an attractive force on the piston since the piston magnet is rigidly mounted to the piston. The scenario shown in FIG. 5 corresponds to the scenario shown in FIG. 2 or during the moving from the rest position towards the labelling position shown in FIG. 3. In the resting position, the drive coupling housing 203 is positioned adjacent to said fixed magnet 204 with the piston magnet 205 placed (see FIG. 2) therebetween.

As the drive coupling housing 203 is attached to the belt (see FIG. 2), this attractive force state causes, upon moving the drive coupling housing 203 downward towards the labelling position, a simultaneous linear movement of the piston 201.

Figure 6:
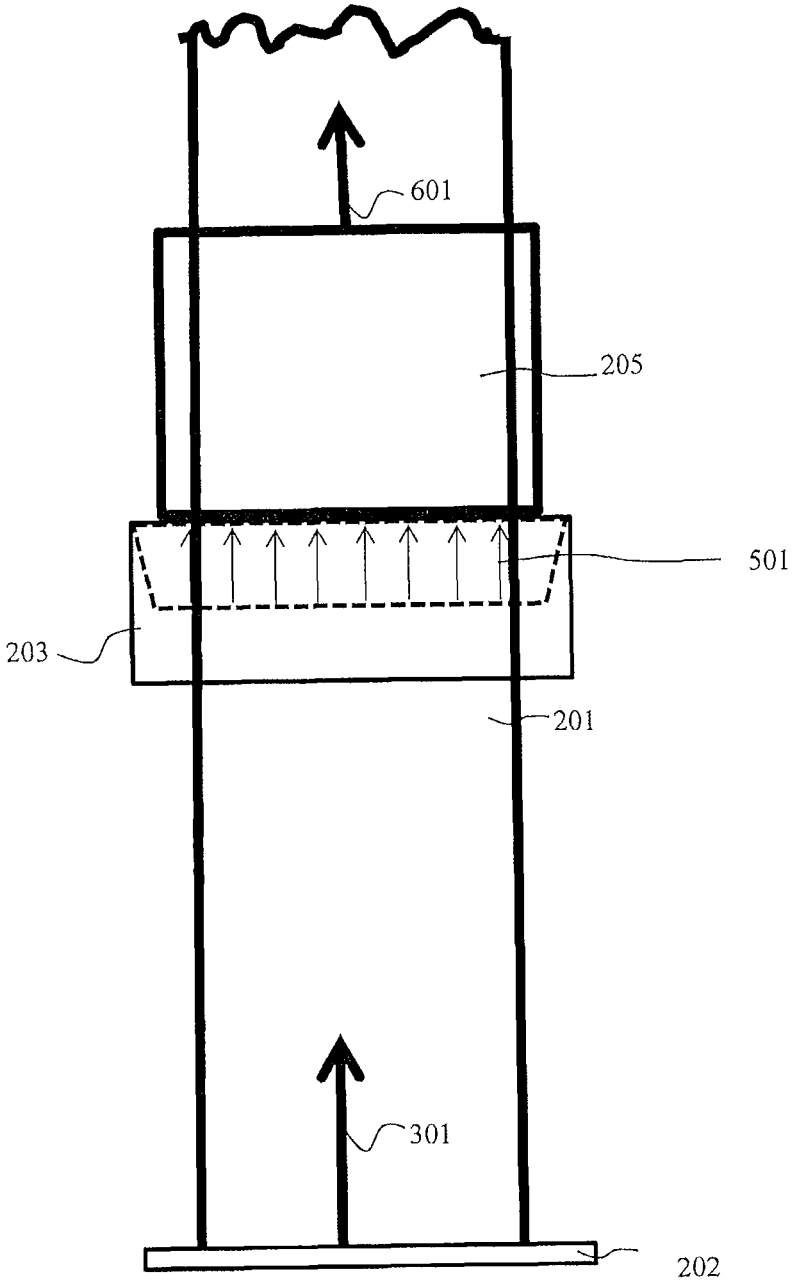
FIG. 6 depicts the view of FIG. 5 at a subsequent step in the operation of the device.

FIG. 6 depicts the scenario in FIG. 3 where the labelling pad 202 comes into contact with the object to be labelled, causing an opposite repelling force from the object onto the labelling pad. This opposite force causes a displacement of the piston magnet 205 from the localized magnetic field 501. The field of the fixed magnet 204 has the same direction as that of the localized magnetic field 501. Moreover the fixed magnet is selected such that its field strength is of a size such that, upon release of said piston magnet from said localized magnetic field, said fixed magnet exerts a magnetic force 601 larger than the force exerted by said localized magnetic field, causing the piston magnet and thus the piston to accelerate towards the fixed magnet. This scenario is shown in FIGS. 3*a* and *b*. This movement of the piston back to the resting position is depicted in FIGS. 4*a* and *b*. The piston accelerates back to the resting position, leaving the drive coupling housing 203 behind initially. The drive coupling housing is operated by a control unit (not shown) that automatically moves the drive coupling housing almost immediately back to said resting position, where said attracting force state is established and the labelling device 200 is prepared for the subsequent labelling operation.

A sensor may further be provided to sense when the labelling device has reached the resting position, whereupon a sensing signal may be sent to said control unit.

In one embodiment, said media source may be further provided with a positive pressure, which might be required if blowing the labels onto the objects would be necessary. This may be the case for example if the flexible pad 202 does not come into contact with the object to be labelled for some reason, perhaps because its upper surface is too low. In this embodiment, the non-contact might trigger a signal instructing a control unit to utilize the blowing function of the source media.

As depicted in FIG. 2*a*, the piston 201 may in one embodiment be operable to rotate around a longitudinal axis of the piston as indicated by the arrow 214. Moreover, the piston 201 and the moving mechanism 209 may be operable to move transversely relative to the conveying direction 212 of the object 211 to be labelled. In that way, an exact position and angle position of the label on the object is controllable.

In some embodiments, the piston and/or the moving mechanism is operably connected to a height adjustment mechanism to adjust a threshold height level for said labelling position. As an example, the threshold height level might be 10 mm. Referring to the blowing function above, if the object or part of the object to be labelled is below this height level, said blowing function might be implemented, but this would typically be considered as rather rare occurrence.

In addition to the above, the time taken to go from said resting position to the labelling position and back to the resting position may be measured and utilized to control the flow of objects to be labelled and thereby prevent an overflow of objects.

As already mentioned, the objects referred to may be any type of objects, but the labelling machine is particularly suitable for labelling food items (that may have been vacuum packed or wrapped with a film) that are of irregular shape, such as a whole chicken, for example.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practising the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims or embodiments does not indicate that a combination of these measures cannot be used to advantage.

The invention claimed is:

1. A labelling device for labelling objects, in particular moving objects, comprising:

a linearly displaceable piston operably connectable to a moving mechanism for moving the piston from a resting position to a labelling position and vice versa;

a label carrying mechanism arranged at the distal end of the piston for carrying an adhesive label and for affixing the adhesive label to an object via physical contact with the object at said labelling position of the piston; and a force-switching-state system comprising a piston magnet attached to said piston and a drive coupling housing circumferentially surrounding said piston and attached to said moving mechanism in a linearly slidable manner, said drive coupling housing having a cavity arranged for generating a localized magnetic field within said cavity so as to provide an attractive magnetic force on said piston magnet when said piston magnet is positioned in said cavity and define an attractive force state, said said force-switching-state system operable to maintain said piston in relation to said moving mechanism in said attracting force state such that the piston moves with the moving mechanism from said resting position to said labelling position, wherein said physical contact with the object creates an opposite repelling force from the object onto the label carrying mechanism that causes displacement of said piston magnet from said cavity, said displacement causing a change of said force state of said displaceable piston from being in said attracting force state to a repelling force state in which said piston separates from the moving mechanism and moves back to said resting position.

2. A labelling device according to claim 1, wherein said force-switching-state system comprises:

a fixed magnet positioned distally away from said label carrying mechanism at a position defining said resting position, wherein in said resting position said drive coupling housing is positioned adjacent to said fixed magnet with the piston magnet placed therebetween.

3. A labelling device according to claim 2, wherein said opposite repelling force from the object onto the label carrying mechanism causing said separation of said displaceable piston from said moving mechanism is based on linear displacement of the piston magnet from said cavity of the drive coupling housing towards said fixed magnet, said fixed magnet being selected such that, the field strength of the fixed magnet is of a size such that, upon release of said piston magnet from said localized magnetic field, said fixed magnet exerts a magnetic force larger than the force exerted by said localized magnetic field, causing the piston magnet and thus the piston to accelerate towards the fixed magnet.

4. A labelling device according to claim 3, further comprising a control unit operable to automatically move the drive coupling housing back to said resting position and into said attracting force state.

5. A labelling device according to claim 1, wherein said label carrying mechanism includes a flexible pad connected to a media source for providing a negative pressure.

6. A labelling device according to claim 5, wherein a labelling system is arranged at a position in proximity to the label carrying mechanism at said resting position, wherein at said resting position the labelling system supplies a label which is subsequently sucked via said negative pressure and held by the label carrying mechanism by said media source.

7. A labelling device according to claim 5, wherein said media source is further operable to supply a positive pressure.

8. A labelling device according to claim 1, wherein said piston is further operable to rotate around a longitudinal axis of the piston.

9. A labelling device according to claim 1, further comprising a sensor arranged in the proximity of said resting position and adapted to sense when said linearly displaceable piston is in said resting position, the sensing signal from the sensor being utilized by a control unit as input data in operating the inflow rate of objects to be labelled.

10. A labelling device according to claim 4, wherein said moving mechanism is an endless drive belt positioned alongside said piston, comprising at least one driving wheel and operated by said control unit, said drive coupling housing being attached to said endless drive belt.

11. A labelling device according to claim 1, wherein said linearly displaceable piston and said moving mechanism are operably connected to a driving mechanism to adjust the lateral position of the piston and the moving mechanism in a direction transverse to the moving direction of the objects.

12. A labelling device according to claim 1, wherein said linearly displaceable piston is further operably connected to a height adjustment mechanism adapted to adjust a threshold height level for said labelling position.

13. A labelling device according to claim 7, wherein said linearly displaceable piston is further operably connected to a height adjustment mechanism adapted to adjust a threshold height level for said labelling position, and if the threshold height level is above an object to be labelled, a media source signal is issued instructing the media source to switch to a positive pressure state and blow the adhesive label onto the object.

14. A labelling device for labelling objects, in particular moving objects, comprising:

a linearly displaceable piston operably connectable to a moving mechanism for moving the piston from a resting position to a labelling position and vice versa;

a label carrying mechanism arranged at the distal end of the piston for carrying an adhesive label and for affixing the adhesive label to an object via physical contact with the object at the labelling position of the piston; and a force-switching-state system comprising:

a piston magnet rigidly fixed to said piston;

a fixed magnet positioned distally away from said label carrying mechanism at a position defining said resting position; and a drive coupling housing circumferentially surrounding the piston and attached to the moving mechanism in a linearly slidable manner, the drive coupling housing having a cavity facing the fixed magnet, and comprising an arrangement for generating a localized magnetic field within the cavity so as to provide an attractive magnetic force on the piston magnet when the piston magnet is positioned in the cavity and define an attractive force state;

the force-switching state system operable to maintain the piston in relation to the moving mechanism in the attracting force state such that the piston moves with the moving mechanism from the resting position to the labelling position, wherein the physical contact with the object creates an opposite repelling force from the object onto the label carrying mechanism causes separation of the piston from the moving mechanism, the separation causing a change of the force state of the piston from being in the attracting force state to a repelling force state, and causing the piston to move back to said resting position, wherein the displacement of the piston from the resting position, where the drive coupling housing is positioned adjacent to the fixed magnet with the piston magnet placed therebetween, towards the labelling position is based on movement of the moving mechanism and thus linear movement of the drive coupling housing, the attractive magnetic force on the piston magnet causing a simultaneous linear movement of the piston from the resting position to the labelling position.

15. The labelling device of claim 14, wherein the moving mechanism is an endless drive belt positioned alongside the piston, the drive coupling housing being attached to the endless drive belt.

16. The labelling device of claim 14, wherein the label carrying mechanism includes a flexible pad connected to a media source for providing a negative pressure.

17. The labelling device of claim 16, wherein the media source is further operable to supply a positive pressure.

* * * * *